US008931446B2

(12) United States Patent
Wagner et al.

(10) Patent No.: US 8,931,446 B2
(45) Date of Patent: Jan. 13, 2015

(54) CAMSHAFT ADJUSTER

(75) Inventors: Werner Wagner, Hirshcaid (DE); Josef Janitschek, Burgberheim (DE); Mario Arnold, Aurachtal (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 94 days.

(21) Appl. No.: 13/574,703

(22) PCT Filed: Dec. 20, 2010

(86) PCT No.: PCT/EP2010/070215

§ 371 (c)(1),
(2), (4) Date: Jul. 23, 2012

(87) PCT Pub. No.: WO2011/088939

PCT Pub. Date: Jul. 28, 2011

(65) Prior Publication Data

US 2012/0291735 A1 Nov. 22, 2012

(30) Foreign Application Priority Data

Jan. 25, 2010 (DE) ..... 10 2010 005 602

(51) Int. Cl.
*F01L 1/34* (2006.01)
*F01L 1/344* (2006.01)

(52) U.S. Cl.
CPC ..... *F01L 1/3442* (2013.01); *F01L 1/344* (2013.01); *F01L 2001/34483* (2013.01); *F01L 2103/00* (2013.01)
USPC ..... 123/90.17; 123/198 E

(58) Field of Classification Search
USPC ..... 123/90.15, 90.17
See application file for complete search history.

(56) References Cited

U.S. PATENT DOCUMENTS

| | | | | |
|---|---|---|---|---|
| 5,337,711 | A * | 8/1994 | Hampton | 123/90.17 |
| 6,332,439 | B2 * | 12/2001 | Sekiya et al. | 123/90.17 |
| 6,619,248 | B1 * | 9/2003 | Bertelshofer et al. | 123/90.15 |
| 2007/0039576 | A1 | 2/2007 | McCarthy et al. | |
| 2009/0078222 | A1 * | 3/2009 | Murao et al. | 123/90.17 |
| 2010/0089353 | A1 * | 4/2010 | Myers et al. | 123/90.17 |
| 2011/0061616 | A1 * | 3/2011 | Watanabe | 123/90.15 |
| 2011/0120399 | A1 * | 5/2011 | Weber | 123/90.15 |
| 2011/0162601 | A1 * | 7/2011 | Fujiyoshi et al. | 123/90.15 |
| 2012/0318222 | A1 * | 12/2012 | Weber | 123/90.15 |
| 2013/0019829 | A1 * | 1/2013 | Weber | 123/90.17 |
| 2013/0055975 | A1 * | 3/2013 | Bosel | 123/90.15 |
| 2013/0186356 | A1 * | 7/2013 | Schelter | 123/90.15 |

FOREIGN PATENT DOCUMENTS

| | | | |
|---|---|---|---|
| DE | 102005011452 | | 9/2006 |
| DE | 102005011452 | A1 * | 9/2006 |
| DE | 102006002993 | | 8/2007 |
| DE | 102008001078 | | 10/2009 |
| DE | 102008032032 | | 1/2010 |

* cited by examiner

*Primary Examiner* — Thomas Denion
*Assistant Examiner* — Steven D Shipe
(74) *Attorney, Agent, or Firm* — Volpe and Koenig, P.C.

(57) ABSTRACT

A camshaft adjuster (2) having a locking cover (1) formed of sheet metal, wherein the locking cover (1) has a substantially disc-shaped base surface (3) and has a collar (7), which extends in an axial direction (5) and which runs at least partially around the base surface (3), for receiving a spring cover (31). As a result of the production of the locking cover (1) from sheet metal in combination with a turned-up collar (7), the locking cover (1) can be produced simply and cost-effectively and nevertheless offers adequately high strength despite the low material thickness.

13 Claims, 2 Drawing Sheets

CAMSHAFT ADJUSTER

FIELD OF THE INVENTION

The present invention relates to a camshaft adjuster having a locking cover, the locking cover having a substantially disk-shaped base surface, and having a collar that extends in an axial direction and runs at least partly around the base surface, for receiving a spring cover.

BACKGROUND

A camshaft adjuster of the type noted above is disclosed in DE 10 2006 002 993 A1. The camshaft adjuster has a locking cover that is made in one piece from a disk, an axial protrusion, and a chain sprocket. The protrusion of the locking cover is fashioned as a collar running around the disk. In the inner space formed by the collar there is placed a spring cover made of sheet metal. The spring cover is bent around radially externally, and is deformed radially inward after being placed into the protrusion. The spring cover thus lies against the inner bore of the protrusion, under radial pressure.

In principle, a camshaft adjuster is used for the targeted adjustment of the phase position between a camshaft and a crankshaft in an internal combustion engine. Customarily, a camshaft adjuster has a stator that is connected in rotationally fixed fashion to the crankshaft, and has a rotor held in this stator. The rotor is connected in rotationally fixed fashion to the camshaft, and can be adjusted relative to the stator. Through such adjustment, a rotation of the camshaft relative to the stator within a specified angular range can be achieved. In this way, for example, the power output of an internal combustion engine can be increased, or its consumption can be reduced, in a targeted manner.

A locking cover is usually attached to the stator. The locking cover seals the hydraulic chambers of the camshaft adjuster, and can additionally be fashioned so as to hold a return spring.

Overall, large forces act on the individual components of a camshaft adjuster during operation of an internal combustion engine. The individual components of a camshaft adjuster are to be made correspondingly stable in order to withstand these demands. Correspondingly, the production costs are relatively high.

SUMMARY

It is accordingly an object of the present invention to provide a camshaft adjuster having a locking cover that enables economical manufacture, with the same level of functional reliability in the operation of an internal combustion engine.

The object of the present invention is achieved according to the present invention by a camshaft adjuster having the combination of features noted.

Here, a locking cover is provided that has a substantially disk-shaped base surface and has a collar that extends in an axial direction and that runs at least partly around the base surface, for receiving a spring cover. The locking cover is made of sheet metal in the present case.

A locking cover as a part of a camshaft adjuster must withstand large forces during operation. In particular, a locking cover must withstand high oil pressures, while in some cases providing sufficient hold for a return spring. Up to now, those skilled in the art have therefore manufactured a locking cover as a massive component. The massive production, however, result in high material costs and high weight.

Taking into account the above considerations, the present invention makes the surprising finding that, with the provision of an axially raised collar, the locking cover can be made of sheet metal without resulting in a loss of functional capacity of the camshaft adjuster. This is because the collar of the locking cover, running at least partly around the base surface thereof, ensures the required stability of form. In this way, despite low material thickness of the sheet, the stability of the locking cover is ensured even in the installed and loaded state. The present invention therefore departs from the previous preconceptions of those skilled in the art.

The collar running at least partly around the base surface achieves a sufficiently high degree of component rigidity. The collar increases the bending rigidity at the outer diameter of the locking cover, so that it can withstand large forces. In addition, the collar can easily be used for the attachment of a spring cover. For this purpose, the inner and/or outer casing surface of the collar is provided with a plurality of fastening elements. In addition, the collar can be used to fasten, for example, additional components. In addition, the production of the locking cover from sheet metal results in particularly low material costs, and the low weight of the sheet means that the locking cover can be fashioned particularly easily.

In the present context, sheet metal is understood as a flat product made of metal, resulting for example from a rolling process. In particular, the locking cover can be made from fine sheet, having material thickness less than 3 mm. The use of sheet metal thus permits the manufacture of a weight-optimized locking cover.

The base surface of the locking cover is made substantially disk-shaped. It can have an opening used in particular to receive a camshaft. In addition, a locking slotted part for locking the rotor to the stator can be made in the base surface. If warranted, for this purpose an oil channel is additionally made that is used to supply the locking slotted part with a hydraulic fluid, in particular oil. In addition, bores are preferably fashioned in the base surface that can be used to fasten the locking slotted part to a stator.

In addition, the base surface of the locking cover can be fashioned for the holding or fastening of a return spring, for example at a spring base point. The return spring is used to rotate the rotor relative to the stator, so that the rotor can be brought into its initial position or base position, for example when the internal combustion engine is switched off and there is thus a decrease in oil pressure. In this way, the rotor and the stator are brought into the locking position.

Advantageously, the locking cover is produced as a sheet metal formed part. Forming methods, such as deep-drawing methods, are particularly well-suited for the production of metallic components, because these methods have long been known and are easy to carry out. The production outlay and costs can correspondingly be kept low.

Components can be connected to one another easily and quickly using locking connections. Preferably, therefore, a plurality of locking detents are situated on the collar, oriented in the circumferential direction. The detents are in particular embossed on the collar, and can be used for easy attachment of a further component. In this way, two movable components can be fixed axially to one another in the provided position. Here, the connection can be made via a positive connection between the detents and the respective fastening elements on the second component, such as a spring cover. Correspondingly, the detents represent an axial securing against pulling off of the spring cover around the circumference of the locking cover.

In an advantageous embodiment of the present invention, the detent, or each detent, is situated on the inner casing surface of the collar. In this way, an additional component such as a spring cover can be situated inside the collar of the locking cover, for which purpose the spring cover has on its outer casing surface a plurality of corresponding positive connecting elements. These positive connecting elements can for example be fashioned as webs in the circumferential direction, which are engaged from behind by the detents in the assembled state. The spring cover can then easily be pushed axially into the collar of the locking cover and held there by the locking mechanism. This simplifies assembly. In addition, due to the fact that the spring cover is held inside the locking cover, the centrifugal force that acts on the components during operation can be exploited. The collar of the spring cover is pressed radially outward against the collar of the locking cover by the rotational movement, so that the connection between the positively connected elements cannot be released even during operation.

In a further advantageous embodiment of the present invention, the detent, or each detent, is made wedge-shaped in the circumferential direction. Through this design, the parts connected to one another, or paired, can be additionally secured, for camshaft adjusters that rotate to the right or to the left. Overall, the detents situated on the collar of the locking cover enable a simple and compact fixing of an additional cover, or general component, on the locking cover. In addition, the locking connection offers the possibility of simple disassembly of a spring cover.

Preferably, a plurality of recesses, each radially sunk, are situated on the collar. The recesses are used for the rotational securing of a further component such as in particular a spring cover. For example, a positive connecting element, in the form of a detent, can snap into the recesses, thus preventing the two components connected to one another from rotating relative to one another.

In order to make it possible to attach a spring cover inside the collar of a locking cover, the recess, or each recess, is advantageously situated on the inner casing surface of the collar. In this way, an attached spring cover can be held securely by snapping detents situated on the spring cover into the recesses of the locking cover inside the collar.

Usefully, a locking slotted piece and an oil channel are made in the base surface of the locking cover. The locking slotted piece is used for the rotationally secure locking of a rotor. It is made in particular in the form of a depression in the base surface of the locking cover. A piston for locking, i.e. for the positive mechanical connection of a rotor to a stator, can engage in this depression. Here, the piston holds the rotor fixedly in a provided position. In order to release the connection, the piston can be lifted out of the depression. This is done by supplying oil to the locking slotted part, using the oil channel.

Preferably, the oil channel is made at a distance from the locking slotted part. In this way, the supply of oil to the locking slotted part can take place only when a connection between the oil channel and the locking slotted part is created by a rotor placed into the stator. For this purpose, the rotor has a "supplementary" oil channel. Such a design prevents external leakage in the displaced state, because at that time there is no connection between the locking slotted part and the oil channel.

Preferably, a number of substantially hollow cylindrical nut supports are also made in the base surface. Nuts can be pressed into these nut supports. Via pressed-in nuts, threading can easily be provided in the base surface of the locking cover. The threads are used to receive fastening elements, such as in particular screws, so that the locking cover can be connected to a stator. The nut supports also result in improved perpendicularity of the thread axes of the pressed-in nuts.

In a particularly advantageous embodiment of the present invention, the camshaft adjuster has a spring cover having a substantially disk-shaped base surface and having a collar that extends in an axial direction and that runs at least partly around the circumference of the base surface, the spring cover being placed with its collar into the collar of the locking cover.

In the installed state, a spring cover can be connected to a locking cover, and is used in particular for the mounting of a return spring. Here, the return spring can be fastened, under pre-tension, on the locking cover, in particular on a mounting element or a spring base point on the base surface of the locking cover. Due to the pre-tension of the return spring, this spring has a high reset force, and should correspondingly be positioned between two components that hold the spring in its shape.

The spring cover of the camshaft adjuster has on the outer casing surface of its collar a plurality of positive connecting elements that work together with the collar of the locking cover. The positive connecting elements can be fashioned in various ways. Here, it is in particular provided that they are fashioned in order to hold the spring cover in the locking cover, so that a fixed connection with the locking cover is possible. For example, a locking connection can be provided between the spring cover and a locking cover.

The collar of the spring cover runs at least partly around the base surface of the spring cover, which has an opening for receiving a camshaft. In this way, the spring cover is given stability, because the collar increases the component rigidity of the spring cover, and can compensate or prevent undesired deformations under the action of external force.

Advantageously, the spring cover is produced as a sheet metal formed part. The use of sheet metal incurs low material costs and offers the possibility of producing the spring cover with low weight. Moreover, forming methods are easy to carry out. Accordingly, a small manufacturing outlay is required, so that the production costs can be kept low.

In an advantageous embodiment of the present invention, a web that is situated so as to be directed radially outward is provided as a positive connecting element of the spring cover. The web is fashioned as a counter-piece to a detent, and is thus used to form a locking connection in particular to a locking cover, so that a secure connection can be ensured between the two components. In this way, the locking connection provides an overall axial securing against pulling out of the spring cover.

In a further advantageous embodiment of the present invention, as a positive connecting element of the spring cover a detent fashioned in the circumferential direction is provided. The detents are fashioned so that they are capable of engaging in recesses that are situated in particular on the inner casing surface of a locking cover. The detents can snap into the recesses and are thus secured against rotation of the spring cover and the locking cover relative to one another.

In the assembled state, the spring cover is pushed axially into the collar of the locking cover and is held there. This hold is created in particular by locking and snapping in of the positive connecting elements situated on the casing surfaces of the collars. For this purpose, the webs of the spring cover are advantageously engaged from behind by the detents of the locking cover, and the detents of the spring cover snap into the recesses of the locking cover.

This inner receiving results in the advantage that the locking connection between the detents and the webs, like the connection between the detents and the recesses, is not released during running operation. For example, a fixed connection of the spring cover to a locking cover is ensured despite the action of centrifugal forces during operation, or due to vibration of components that are to be secured, such as a return spring.

In principle, the number of positive connecting elements fashioned as webs or recesses is variable depending on the embodiment. The number corresponds in particular to the number of detents and recesses on the collar of a locking cover.

BRIEF DESCRIPTION OF THE DRAWINGS

In the following, exemplary embodiments of the present invention are explained in more detail on the basis of the drawing.

In the following, identical components in the individual exemplary embodiments have been provided with the same reference characters.

DETAILED DESCRIPTION OF THE PREFERRED EMBODIMENTS

Figure 1:
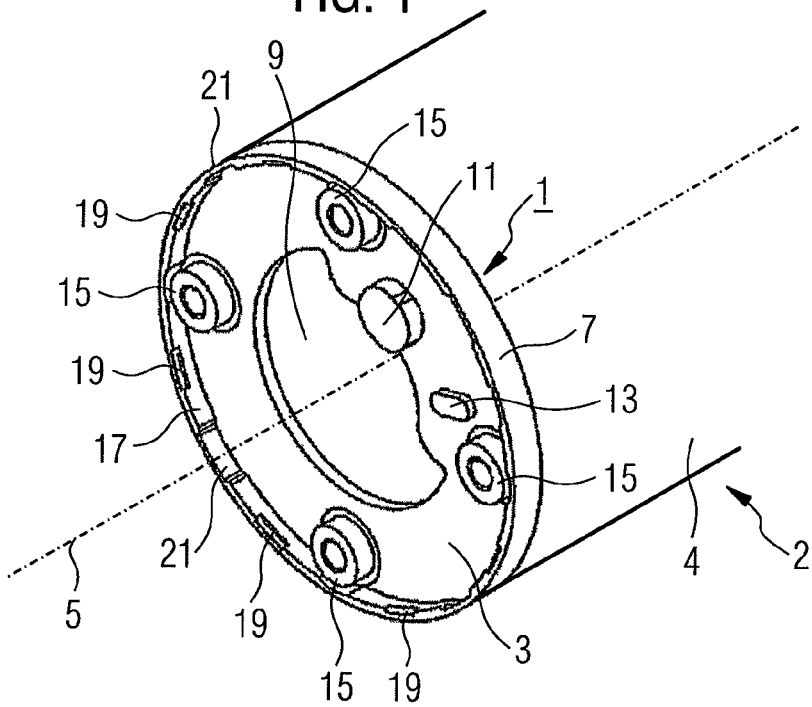
FIG. 1 shows a camshaft adjuster having a locking cover, in a three-dimensional representation.

FIG. 1 shows a locking cover 1 on a camshaft adjuster 2 having a disk-shaped base surface 3. The camshaft adjuster 2 is shown only schematically, in the form of a stator 4 on the locking cover 1. The locking cover 1 is shown in a three-dimensional representation.

The locking cover 1 is produced as a formed part. The locking cover 1 is made from a fine sheet metal having a thickness of approximately 2.5 mm. The disk-shaped base surface 3 has a collar 7 extending in an axial direction 5. The collar 7 receives a spring cover not shown in FIG. 1. The spring cover is shown in a detailed embodiment in FIG. 2.

The base surface 3 has a central opening 9. In the installed state, a camshaft can be accommodated inside the opening 9. A locking slotted part 11 and an oil channel 13 at a distance therefrom are made in the base surface 3. In the installed state inside a camshaft adjuster, the locking slotted part 11 is used to produce the rotationally fixed locking of a rotor to a stator. The oil channel 13 is used to supply oil to the locking slotted part 11. Due to the distance between the two, the supply of oil to the locking slotted part 11 via the oil channel 13 is ensured only by a "supplementary" oil channel made on the rotor. Thus, in the displaced state, i.e. when there is no connection between the locking slotted part 11 and the oil channel 13, an external leakage is prevented.

In addition, a plurality of hollow cylindrical nut supports 15 are embossed in the base surface 3. Nuts are pressed into the nut supports 15. The embossing of nut supports 15 can improve the perpendicularity of the thread axes of the pressed-in nuts. Screws can be received in the nut supports 15, with these screws being screwed together with the nuts. The screws fasten the locking cover 1 onto the stator 2. FIG. 1 does not show the screws or the nuts.

The collar 7 runs around the full circumference of a surface 3 of the locking cover 1. It has on its inner casing surface 17 a plurality of detents 19, each oriented in the circumferential direction and having a wedge shape. The detents 19 are used to connect a spring cover that can be received inside the inner casing surface 17 of locking cover 1. Through positive locking elements situated on its collar, the spring cover can enter into a locking connection with the detents 19, so that the two components are axially fixed relative to one another in the desired position. Correspondingly, the detents 19 form an axial securing against pulling out of a spring cover, around the circumference of the locking cover 1. The detents 19 are made so as to be wedge-shaped in the circumferential direction. This additionally secures the spring cover and the locking cover 1 against pulling out of the spring cover.

In addition, a plurality of radially sunk recesses 21 are situated on the inner casing surface 17. The recesses 21 are sunk into the collar 7 and thus make it possible for additional positive connecting elements of a spring cover to engage therein. Such a connection is used for the rotational securing of a spring cover in the installed state. Thus, through the detents 19 and the recesses 21, a spring cover placed into locking cover 1 can be secured axially and in the circumferential direction.

The locking cover 1 can in addition have a mounting element for positioning and mounting a return spring on its base surface 3. Here, the return spring is standardly fastened on the locking cover 1 under pre-tension, and is then held in its position by a spring cover pushed into the locking cover 1.

Figure 2:
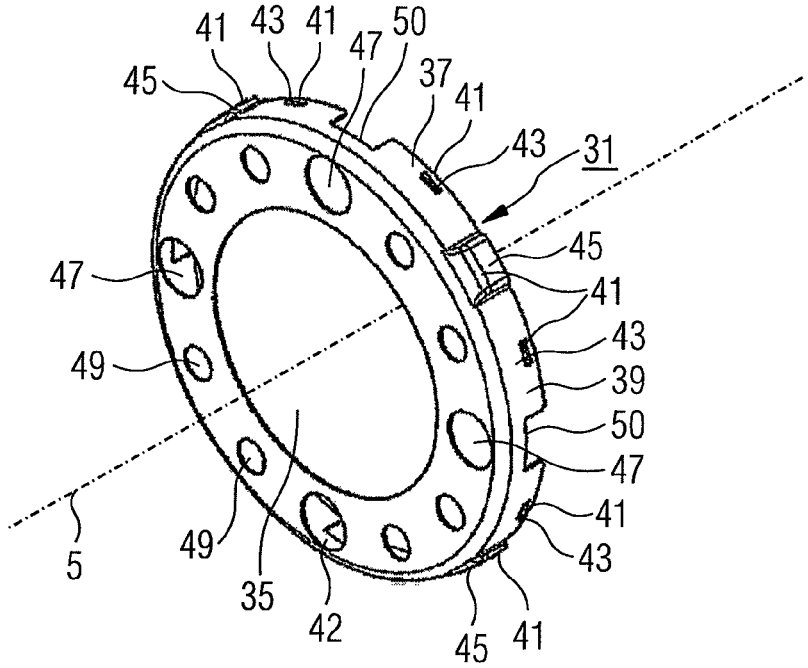
FIG. 2 shows a camshaft adjuster having a spring cover, in a three-dimensional representation.

FIG. 2 shows a spring cover 31 for a camshaft adjuster, in a three-dimensional representation. Similarly to the locking cover shown in FIG. 1, the spring cover 31 has a substantially disk-shaped base surface 33 having a central opening 35 for receiving a camshaft. As a sheet formed part, it is also made of fine sheet having a thickness of approximately 0.5 mm.

The spring cover 31 is fashioned with a collar 37 that extends in the axial direction 5, said collar running around the base surface 33. The spring cover 31 can be placed with its collar 37 into the collar 7 of the locking cover 1 shown in FIG. 1. In order to enable a connection between the two parts, a plurality of positive connecting elements 41 are situated on an outer casing surface 39 of the collar 37. These positive connecting elements 39 are fashioned as webs 43 and as detents 45.

Overall, the spring cover 31 can easily be pushed axially into the collar 7 of the locking cover 1 and held there by the locking connection between the detents 19 and the webs 43. The engagement of the detents 35 in the recesses 21 on the inner circumference of the locking cover secures the spring cover 31 against rotation.

In addition, in the base surface 33 a plurality of holes 47 are made through which, in the installed state, there can extend the ends of the screws that connect the locking cover 1 to a stator 4. Additional holes 49 are used for weight reduction or for axial withdrawal.

In addition, openings 50 for the nut supports 15 of the locking cover 1 are made in the collar 37. the openings 50 are situated at the points at which the nut supports 15 would come into contact with the collar 37 of the spring cover 31 during assembly and would prevent pushing in of the spring cover. Due to the openings 50, the spring cover 31 can easily be pushed into the locking cover 1.

Figure 3:
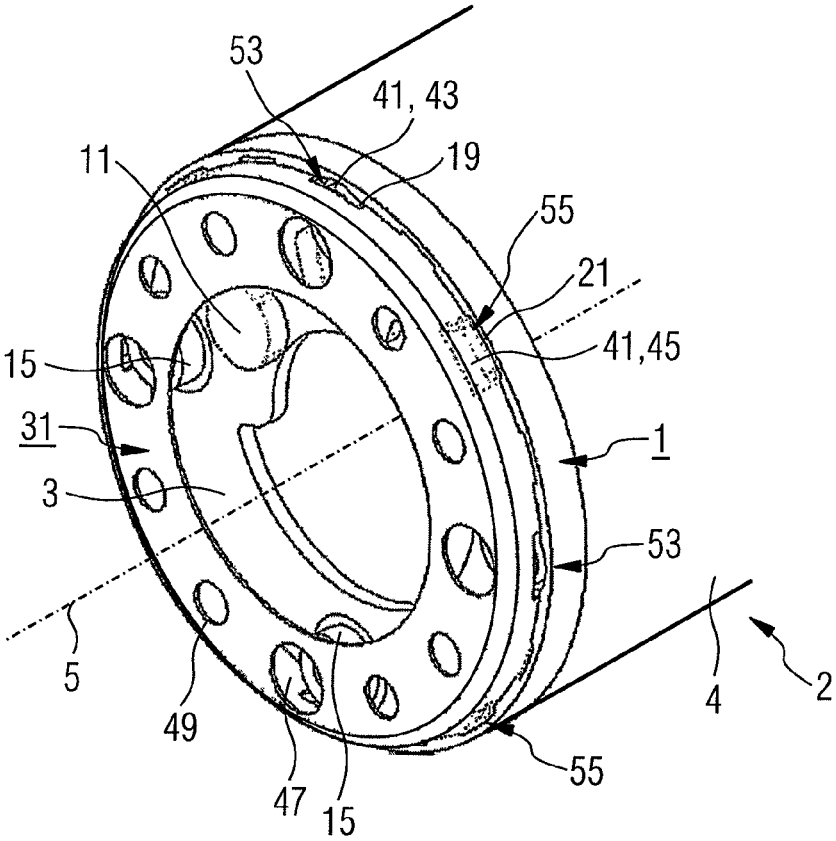
FIG. 3 shows a camshaft adjuster having a locking cover according to FIG. 1 and having a spring cover according to FIG. 2, in a three-dimensional representation.

FIG. 3 schematically shows a camshaft adjuster 2 having a locking cover 1 according to FIG. 1, and having a spring cover 31 according to FIG. 2. Here, the camshaft adjuster 2 is indicated only schematically, whereas the locking cover 1 and the spring cover 31 are shown in a three-dimensional representation. Both the locking cover 1 and the spring cover 31 have already been described in detail in the two preceding Figures, so that reference is made to the description accompanying these Figures.

The spring cover 31 is placed with its collar 37 into the collar 7 of the locking cover 1. Here, the webs of the spring cover 31 are engaged from behind by the detents 19 of the locking cover 1, so that a locking connection 53 is created between the detents 19 and the webs 43. The detents 45 of the spring cover 31 are snapped into the recesses 21 of the locking cover 1, forming a positive connection 55. Overall, this fastening can ensure rotational securing of the two parts relative to one another, as well as securing of the spring cover 31 against axial withdrawal.

LIST OF REFERENCE CHARACTERS

1 locking cover
2 camshaft adjuster
3 base surface
4 stator
5 axial direction
7 collar
9 opening
11 locking slotted part
13 oil channel
15 nut support
17 inner casing surface
19 detent
21 recess
31 spring cover
33 base surface
35 opening
37 collar
39 outer casing surface
41 positive connecting element
43 webs
45 detents
47 hole
49 hole
50 opening
53 locking connection
55 positive connection

The invention claimed is:

1. A camshaft adjuster comprising a locking cover made of sheet metal, the locking cover having a substantially disk-shaped base surface, and having an integrally extending collar, which extends in an axial direction and which runs at least partly around the base surface that stabilizes the base surface, and a spring cover received by the locking cover, a plurality of detents, each oriented in a circumferential direction, are situated on the collar of the locking cover, and at least one of the detents is situated on an inner casing surface of the collar.

2. The camshaft adjuster as recited in claim 1, wherein the locking cover is a formed sheet part.

3. The camshaft adjuster as recited in claim 1, wherein at least one of the detents is wedge-shaped in the circumferential direction.

4. The camshaft adjuster as recited in claim 1, wherein a plurality of recesses, each radially sunk, are situated on the collar of the locking cover.

5. The camshaft adjuster as recited in claim 4, wherein at least one of the recesses is situated on an inner casing surface of the collar.

6. The camshaft adjuster as recited in claim 4, wherein the spring cover has a substantially disk-shaped base surface and a collar that extends in an axial direction and runs at least partly around the base surface of the spring cover, the spring cover being placed with the collar thereof into the collar of the locking cover.

7. The camshaft adjuster as recited in claim 6, wherein the spring cover is a sheet formed part.

8. The camshaft adjuster as recited in claim 1, wherein a locking slotted part and an oil channel spaced apart from the locking slotted part are located in the base surface of the locking cover.

9. The camshaft adjuster as recited in claim 1, wherein a plurality of substantially hollow cylindrical nut supports are embossed into the base surface of the locking cover.

10. A camshaft adjuster comprising a locking cover made of sheet metal, the locking cover having a substantially disk-shaped base surface, and having an integrally extending collar, which extends in an axial direction and which runs at least partly around the base surface that stabilizes the base surface, and a spring cover received by the locking cover, a plurality of detents, each oriented in a circumferential direction, are situated on the collar of the locking cover, a plurality of recesses, each radially sunk, are situated on the collar of the locking cover, the spring cover has a substantially disk-shaped base surface and a collar that extends in an axial direction and runs at least partly around the base surface of the spring cover, the spring cover being placed with the collar thereof into the collar of the locking cover, and a plurality of positive connecting elements that work together with the collar of the locking cover are arranged on an outer casing surface of the collar of the spring cover.

11. The camshaft adjuster comprising a locking cover made of sheet metal, the locking cover having a substantially disk-shaped base surface, and having an integrally extending collar, which extends in an axial direction and which runs at least partly around the base surface that stabilizes the base surface, and a spring cover received by the locking cover, a plurality of detents, each oriented in a circumferential direction, are situated on the collar of the locking cover, a plurality of recesses, each radially sunk, are situated on the collar of the locking cover, the spring cover has a substantially disk-shaped base surface and a collar that extends in an axial direction and runs at least partly around the base surface of the spring cover, the spring cover being placed with the collar thereof into the collar of the locking cover, and there is provided as a positive connecting element of the spring cover at least one web that is situated in a circumferential direction and is oriented radially outwards.

12. The camshaft adjuster as recited in claim 11, wherein there is provided as a further connecting element of the spring cover at least one detent fashioned in a circumferential direction.

13. The camshaft adjuster as recited in claim 11, wherein the at least one web of the spring cover is engaged from behind by the detents of the locking cover, and detents of the spring cover are snapped into the recesses of the locking cover.

* * * * *